United States Patent [19]

Tyson et al.

[11] 4,126,230

[45] Nov. 21, 1978

[54] DOCUMENT HANDLING SYSTEM

[75] Inventors: George F. Tyson; Robert A. Keeler, both of Grand Rapids, Mich.; Raymond L. Myers, Vestal, N.Y.

[73] Assignee: Steelcase Inc., Grand Rapids, Mich.

[21] Appl. No.: 717,520

[22] Filed: Aug. 25, 1976

Related U.S. Application Data

[62] Division of Ser. No. 546,280, Feb. 3, 1975, Pat. No. 4,034,864.

[51] Int. Cl.[2] ..... A47F 5/00

[52] U.S. Cl. ..... 211/50; 211/88; 211/189; 248/188; 248/223.3

[58] Field of Search ..... 211/50, 88, 87, 189, 211/126, 184; 248/188, 223.3, 224.4, 224.3, 225.3, 226.4; 206/557, 558, 561

[56] References Cited

U.S. PATENT DOCUMENTS

| | | | |
|---|---|---|---|
| 3,045,961 | 7/1962 | Cygan | 248/223 |
| 3,112,912 | 12/1963 | Alvarez | 248/223 |
| 3,144,248 | 8/1964 | Fornell et al. | 27/58 |
| 3,178,029 | 4/1965 | Meyers | 206/558 |
| 3,495,718 | 2/1970 | Romero | 211/126 |
| 3,535,508 | 10/1970 | Warshauser | 248/226.4 X |
| 3,602,159 | 8/1971 | Marshak | 108/111 |
| 3,698,565 | 10/1972 | Weber | 211/126 X |
| 3,794,281 | 2/1974 | Munsey | 248/188 |

FOREIGN PATENT DOCUMENTS

| | | | |
|---|---|---|---|
| 632,642 | 12/1961 | Canada | 211/126 |
| 1,285,520 | 1/1962 | France | 211/126 |

*Primary Examiner*—Roy D. Frazier
*Assistant Examiner*—Robert W. Gibson, Jr.
*Attorney, Agent, or Firm*—Price, Heneveld, Huizenga & Cooper

[57] ABSTRACT

A manual document handling system for use in processing and handling documents in offices and the like including a support panel on which specially designed trays are hung. The support panel is of a modular design including horizontal slats, the number of which varies in accordance with the height of the panel desired and the number and sizes of the trays to be mounted thereon. A unique support for the slats is provided to easily assemble the support panel. The trays are of a special shape for easy insertion, storing and retrieval of the documents in an orderly fashion, and accessories therefor make the trays adaptable for identification of the documents and the accommodating of different sizes and shapes of documents.

14 Claims, 18 Drawing Figures

DOCUMENT HANDLING SYSTEM

CROSS REFERENCE TO RELATED APPLICATION

This is a division of application Ser. No. 546,280, filed Feb. 3, 1975, Now U.S. Pat. No. 4,034,864.

BACKGROUND OF THE INVENTION

In professional, industrial, business, and other types of offices one problem which has plagued the operation of such offices is the processing and handling of documents which are in an "active" state, i.e., documents that are being used and worked on but need temporary storage maybe for an hour or a day or two. The office equipment industry offers very adequate files, drawers, and bins for storage purposes, but these are primarily designed to handle documents which are in an "inactive" state, that is, documents that have passed beyond the "active" state and are in effect in final storage. Therefore, there has been a long felt need for office equipment whereby documents that are in the "active" state can be organized and classified, temporarily stored, and then easily handled and conveyed to different departments in the office.

SUMMARY OF THE INVENTION

The present invention relates to a manual document handling system which provides for an easy and organized way of classifying, temporarily storing, and moving documents from one department to another or from one person within a department to another person in the same department.

The apparatus of this invention for accomplishing this organization and classification of documents is a simple structure which is relatively easy to manufacture, assemble and install with relation to other items of furniture within the office, such as tables, storage cabinets and the like. This equipment makes possible the easy insertion and retrieval of the documents in the trays of the system. It makes the identification of the documents and the transportation of the documents from one station to another a relatively easy task with less chance of errors and of losing the documents.

The structure of the support for the trays makes the hanging of the trays and removal of the trays from the support relatively easy and less burdensome than in conventional type of storage systems.

The system makes a highly visible display of the "active" documents. It makes for a neat appearing but otherwise visible display of such documents. The present invention makes the employee working in the office with the use of this system more productive at his job. It provides secondary benefits in supervisory/management control and planning, elimination of duplicate sorting processes, and faster documents movement and increased employee knowledge of what is occurring as these "active" documents are worked on and transmitted from place to place.

The present invention makes for a wide variety of different shapes of trays for different sizes and shapes of documents and allows for a number of trays of different shapes and sizes to be used in any given space.

Having described very briefly the various objects and advantages of the present invention, reference is now made to the drawings wherein:

BRIEF DESCRIPTION OF THE DRAWINGS

FIG. 11 is a partial, perspective, exploded view of the base leg for the free-standing support of FIG. 3 and showing a modification for clipping the leg onto a table or the like;

Figure 1:
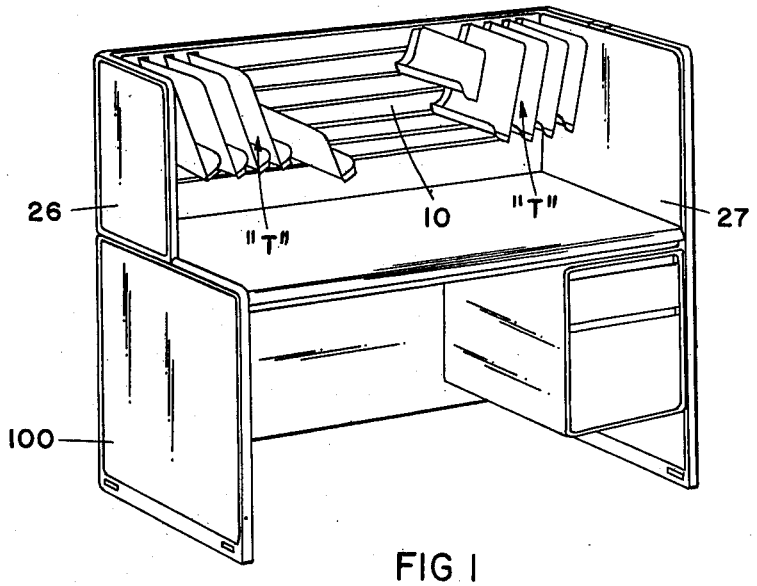
FIG. 1 is a perspective, front elevational view of a desk showing the system of this invention mounted thereon.
Figure 2:
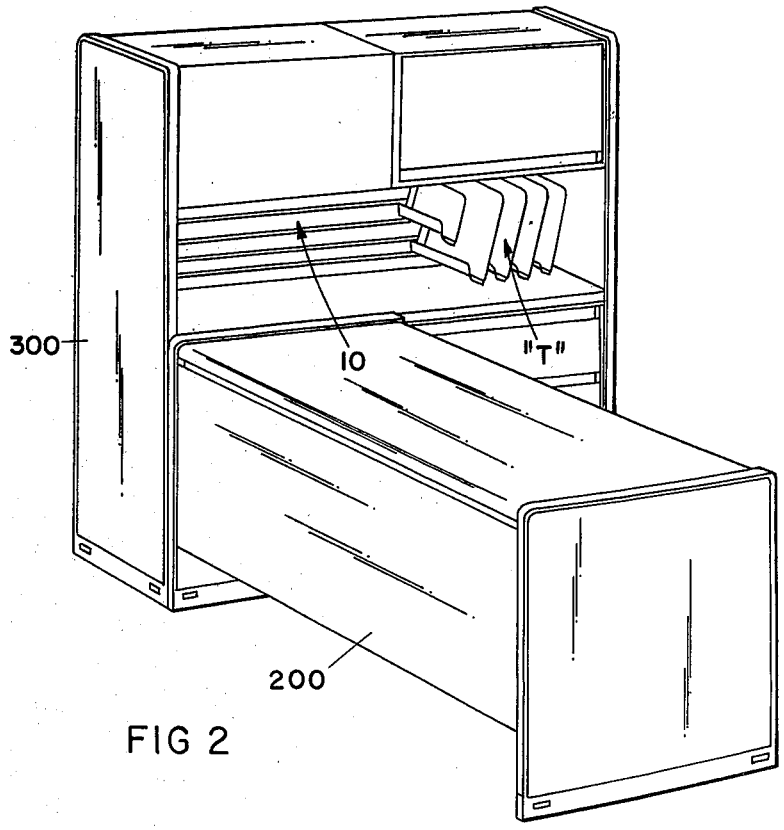
FIG. 2 shows still another arrangement of a desk and a side storage cabinet with the present invention arranged in relation thereto.

Now referring more specifically to the drawings, FIGS. 1 and 2 disclose this invention utilized in conjunction with a desk 100 (FIG. 1) or with a desk 200 and a storage cabinet 300 (FIG. 2). In each example the invention consists of two basic components, a tray support panel 10 and a plurality of trays "T" hung on the support panel 10. The trays can be of different shapes and sizes such as shown in FIG. 4 which illustrates such trays identified by reference numerals 1, 2, 3, 4, 5, 6, 7, 8, and 9. These trays are adapted to be mounted as will be described hereinafter on a support panel 10 (FIGS. 3, 5, 6, and 13).

Figure 3:
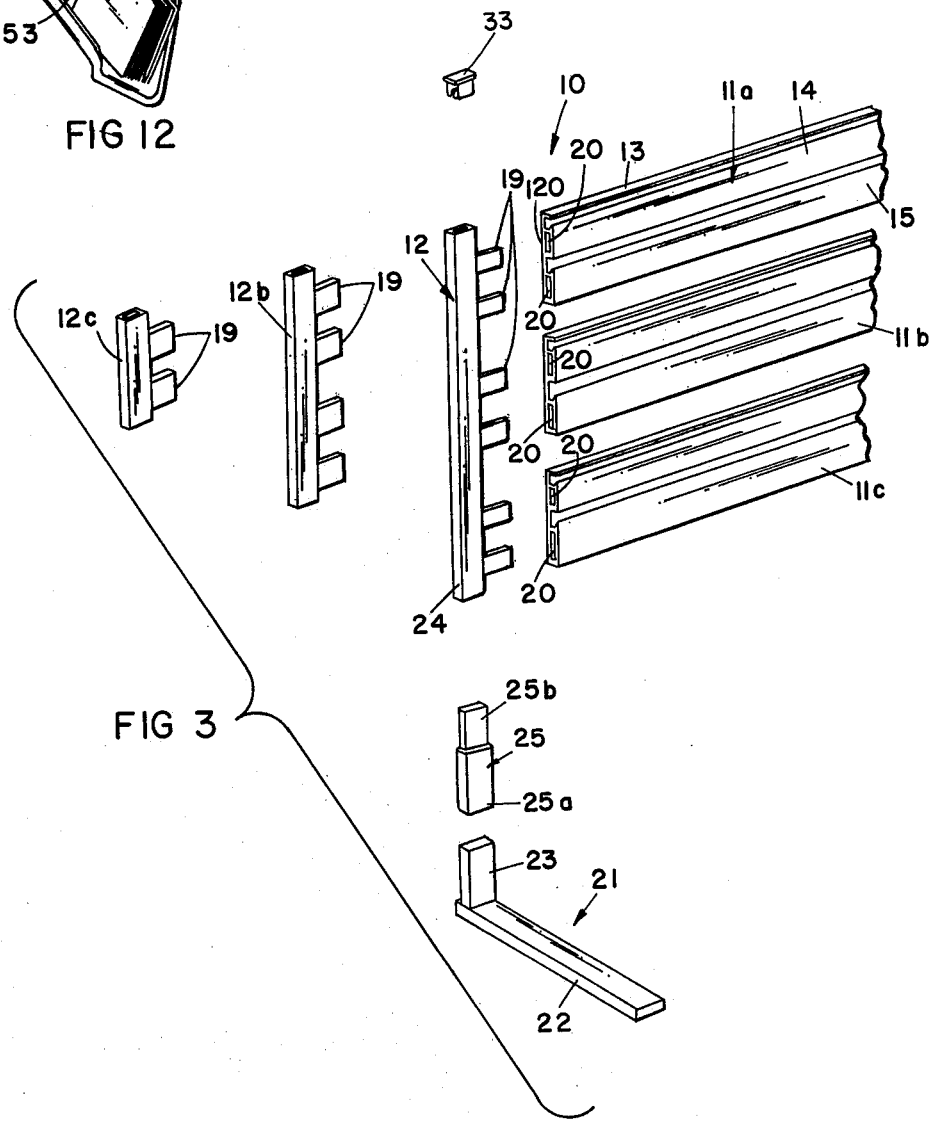
FIG. 3 is an exploded, perspective view of the various components of the tray support panel of this invention which is adapted for a free-standing type of arrangement. This figure also illustrates the modular construction of the tray support panel which can be utilized for different sizes and numbers of trays as desired.
Figure 4:
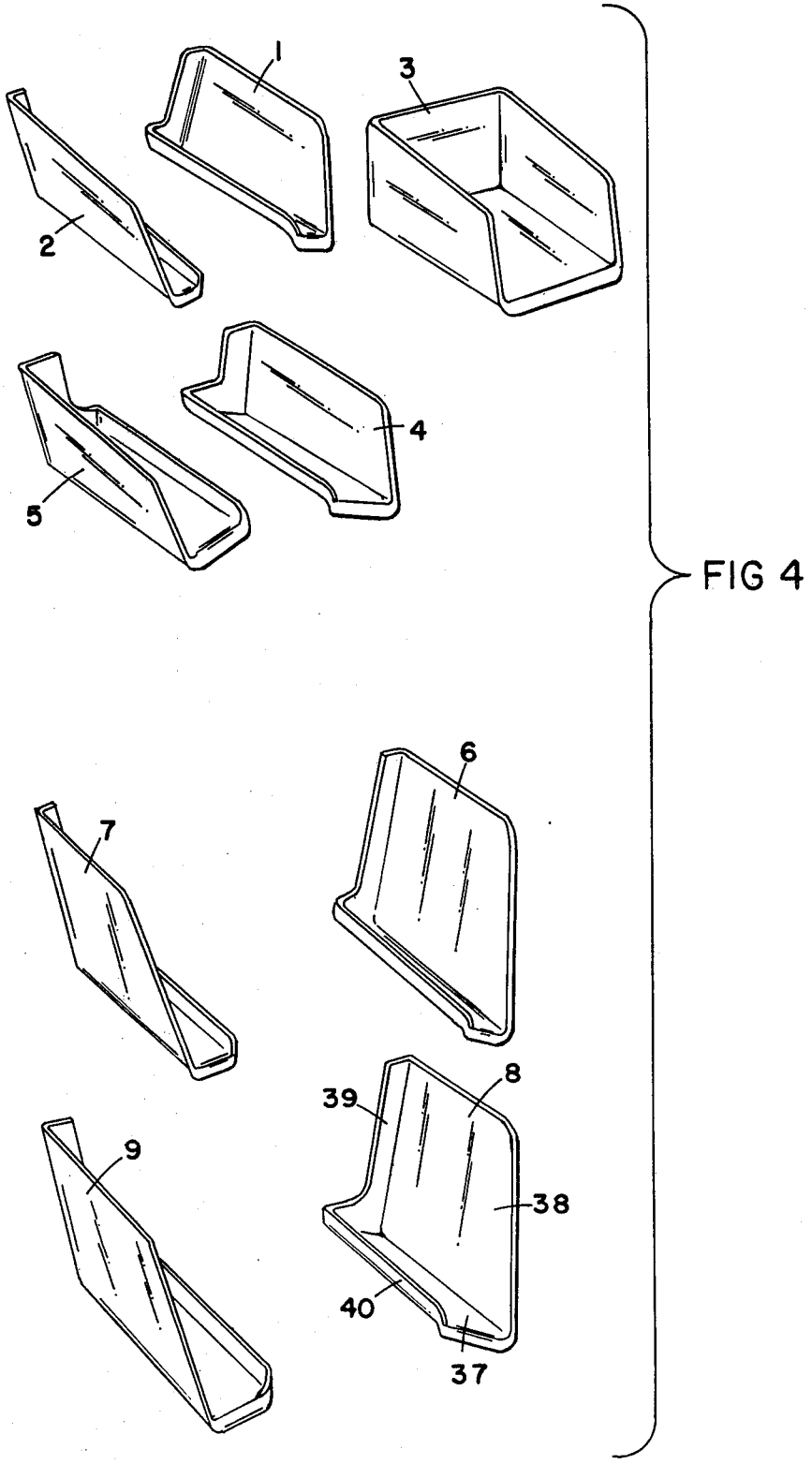
FIG. 4 is a perspective view of a number of different sizes and shapes of trays utilized in the system of this invention.
Figure 5:
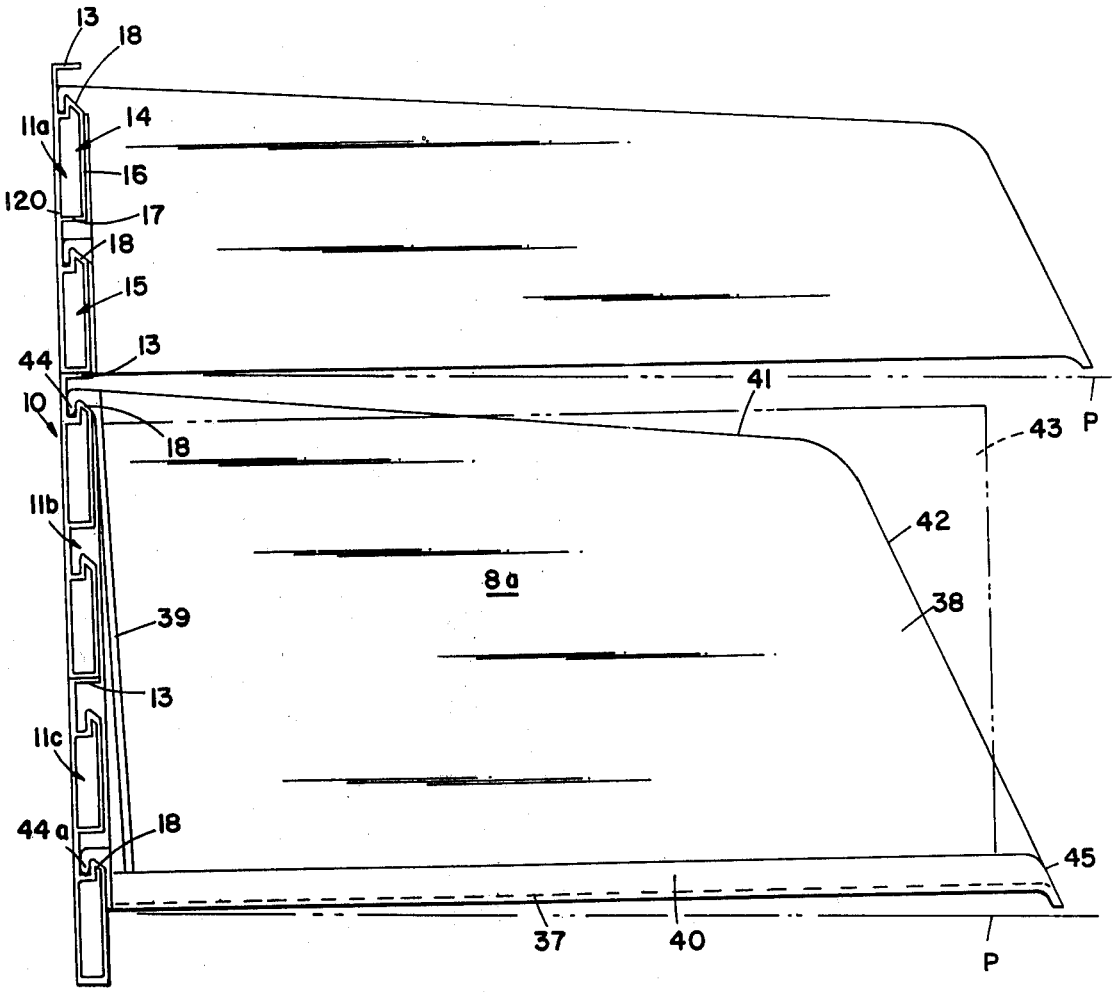
FIG. 5 is a cross-sectional, side elevational view of the combination of trays and tray support panel of this invention.
Figure 6:
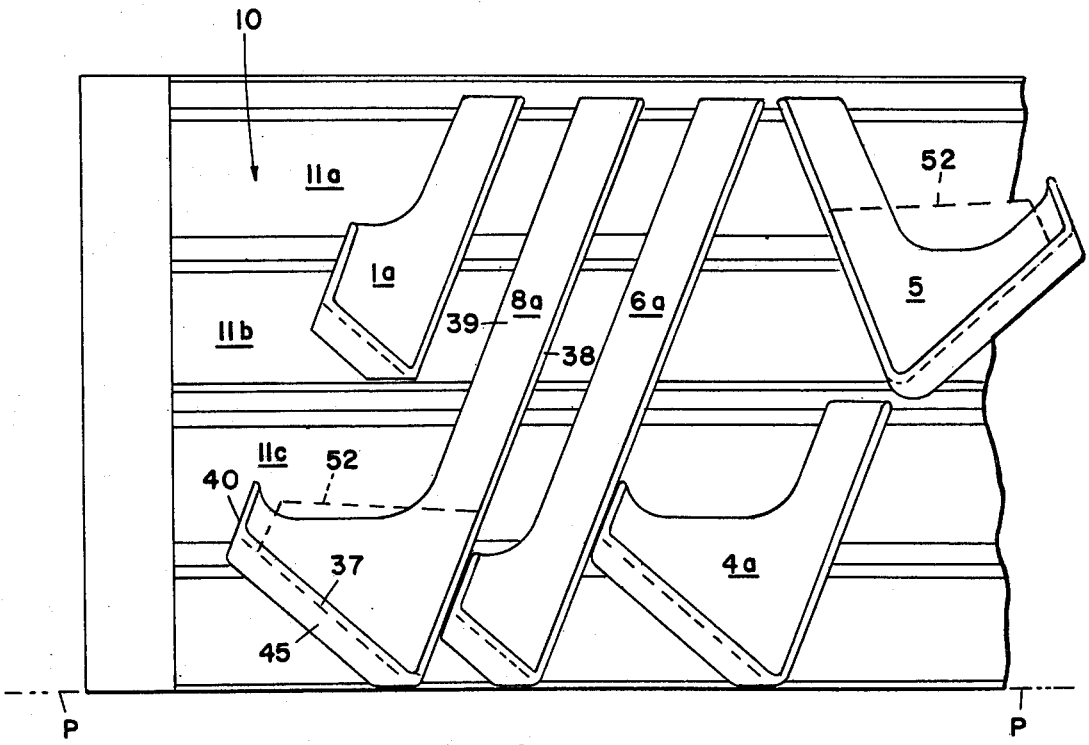
FIG. 6 is a partial, front, elevational view of the trays and tray support panel of this invention.

The panels 10 as illustrated best in FIGS. 3, 5, and 6 are made up of a plurality of slats such as slats **11*a*, 11*b* and 11*c* (FIGS. 3 and 5) each of which are identical. The slats in turn are assembled together by means of the posts 12**, which can be mounted either in a free-standing manner as will be described hereinafter or can in turn be secured to another support as will also be described.

Each of the slats **11*a*, 11*b* and 11*c* are identical. The construction of these slats is best shown in FIGS. 3 and 5. Such construction includes a back wall 120 having a lip 13 at the very top and the two hooks 14 and 15 spaced one above the other. The two hooks 14 and 15 are identical and include a front wall 16, a bottom wall 17 and a hook-shaped upper wall 18. These slats 11***a*, 11*b* and 11*c* can be constructed out of metal by any conventional means such as by extruding or by forming and welding. It is also conceivable that these slats can be constructed of a plastic material.

The hook structures 14 and 15 not only provide a hook on which the tray can be hung but also provide a socket by which the slats can be secured to the posts 12. This socket and plug construction is best shown in FIG. 3 wherein the post 12 is shown with the tabs or plugs 19 received into the passages or recesses 20 on the ends of the slats 11*a*, 11*b* and 11*c*. It should be obvious from the details as shown in FIG. 3 that when the plugs or tabs 19 are inserted into the openings 20 the slats 11*a*, 11*b* and 11*c* are rigidly mounted to the post 12 and thus are secured together to form the panel for hanging the trays on.

As is illustrated by the posts 12, 12*b* and 12*c*, the posts can be of any predetermined length for mounting any predetermined number of slats. Specifically post 12 mounts three slats, post 12*b* mounts two slats, and post 12*c* only one slat.

The support panels 10 can be supported in several ways. FIG. 3 discloses a free-standing type of construction in which there is provided a L-shaped base 21 having a base leg 22 and an upright leg 23. The upright leg 23 is of a shape and size to receive the lower end 24 of the post 12. However, in some instances it is desirable to space the panel above the surface on which the freely mounted support is resting. In such a case an extension member 25 is provided having an end 25*a* and an end 25*b*. End 25*a* is of the same shape and size and has the same opening of the same shape and size as the lower end of the post 24. Thus, the upright leg 23 of the base 21 is received within the end 25*a* of the extension member 25. In like manner, the upper end 25*b* is of reduced size and shape like the upright leg 23 so as to be received within the end 24 of the post. In this construction, as previously stated, the slatted panel is spaced above the surface on which the freely supported support rests.

Figure 13:
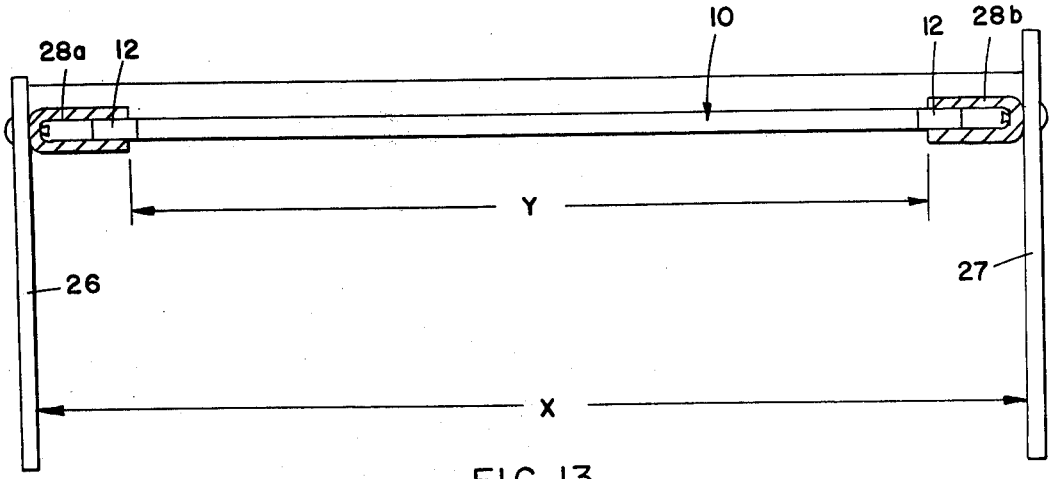
FIG. 13 is a plan view of one means for mounting the tray support panel between two upright panels.

FIG. 13 shows still another construction for mounting the panel 10. This construction is for the purpose of mounting the panel 10 between two panels, for example as illustrated in FIGS. 1 and 2. In this particular instance, U-shaped brackets 28*a* and 28*b* are secured to the spaced end panels 26 and 27, respectively, the number of brackets on each panel being at least two but varying as desired depending upon the height of the panel 10. The posts 12 are received within the brackets 28*a* and 28*b*, the fit being such that the panel 10 will stay put in normal use. However, if the panel 10 is to be removed it can be slid one way or the other so that one of the posts 12 is removed from the brackets on one panel and then the other can likewise to removed. This construction provides for an easy insertion and removal of the panel and also provides for a fit of the support panel when the panels 26 and 27 vary slightly such as in drawers and the like.

Figure 10:
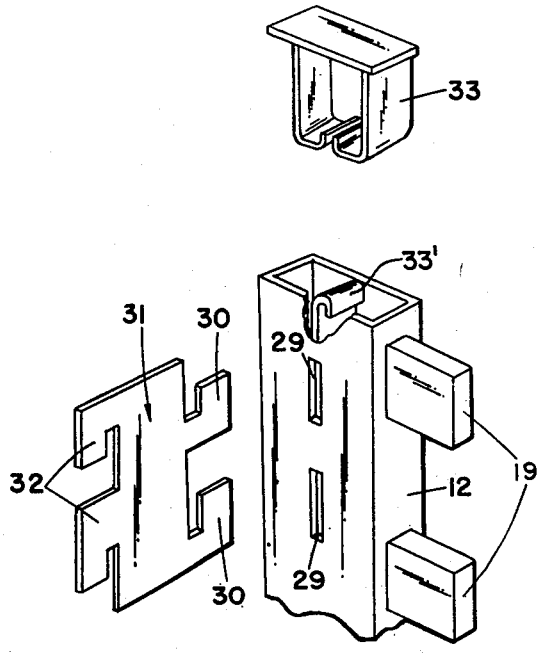
FIG. 10 is also a partial, exploded view of the support posts for the tray support panels.

Still another construction for mounting the panel 10 to upright support members of a panel wall or the like is shown in FIG. 10. In this instance, the post 12 is provided with a plurality of slots 29 which are shaped and sized to receive the hook portions 30 of the bracket 31. The bracket 31 also has the hook portions 32 which extend in an opposite direction than the hooks 30 and thus can be inserted into slots of an upright support member such as one that supports a wall for securing and supporting the post 12 and the entire panel 11 on the wall.

In the post 12 at the very top is a short piece of metal 33' having a bent over end which fits over the top end of the hook 30 which stabilizes the entire assembly. Also shown in FIG. 10 and also in FIG. 3 is the cap 33 for closing the top end of the post 12.

Figure 11:
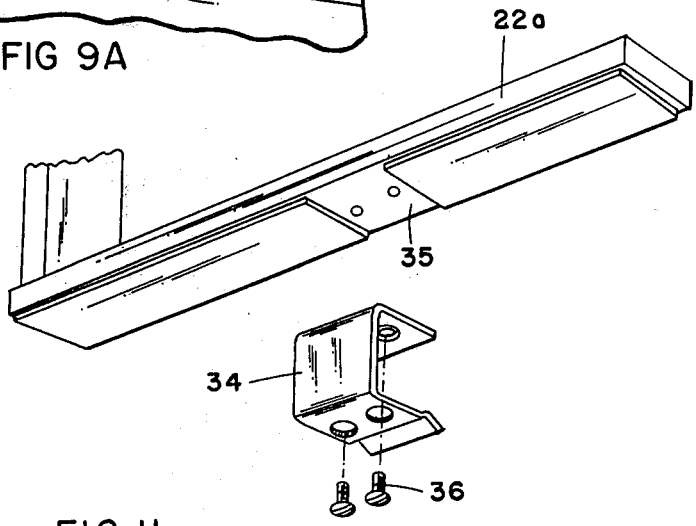

FIG. 11 discloses a construction for stabilizing the base leg of the free-standing construction of FIG. 3. This includes a clip 34 secured in the groove 35 at the bottom of the base leg 22*a*. The clip is secured in the groove 35 by the screws 36 and when so mounted the clip can be slipped over the edge of a table or desk for stabilizing the entire assembly.

Referring to the trays which are best shown in FIGS. 4, 5, and 6, it will be noted that the trays can be of many different shapes and sizes for holding various types of documents; for example, file cards, books, large documents and computer cards. Further, the trays can be made either right or left handed as illustrated. Specifically in FIG. 4, trays 1 and 2 are right and left document holders as are trays 6 and 7 and 8 and 9, respectively. Tray 3 is a book holder. Substantially all of these trays, except for the book holder 3, are constructed similarly except for the dimensions. This construction, as will now be described in relation to trays 8 and 8*a* (FIGS. 4 and 6), include a bottom wall 37, a side wall 38, a back wall or end wall 39 and a retaining lip 40. As will be seen from FIGS. 4, 5 and 6, the bottom wall 37, from back to front, is sloped upwardly from the horizontal plane "P" (FIG. 5) and from side 38 to lip 40 is sloped upwardly from the horizontal plane "P" (FIG. 6). The side wall 38 is sloped either to the right or left depending upon whether it is a right or left hand tray and the angle between side wall 38 and bottom wall 37 is less than 90°. Further, as shown in FIG. 5 the back wall 39 is sloped forwardly from top to bottom. In addition, as shown in FIG. 5 the top edge 41 of the side wall 38 is inclined downwardly and the front edge 42, from bottom to top, is inclined rearwardly. This slope or inclination of the edges 41 and 42 provides an open area on the sides of the documents 43 (shown in phantom in FIG. 5) so that the documents can be grasped more easily when inserted and removed from the tray. It should be understood that although the specific sides and slopes of the sides of tray 8*a* as shown in FIGS. 5 and 6 are described, the same general slopes of the sides of the other trays are the same.

At the back of the tray near the back wall and at the top and bottom of each tray are the hooks 44 and 44*a* as illustrated with relation to tray 8*a* in FIG. 5. These hooks fit over the hooks 18 provided on the panels 10 by the slats 11*b* and 11*c*. It will thus be seen that the trays can hang on the panels by hooking the hooks 44 of the trays over the hooks 18 of the panels.

It will be noted that at the front of tray 8*a* a downturned flange 45 is provided. This flange can be a matted surface to accept pencil write-on in order to identify the documents in the tray, or in the alternative, a gummed label or tape can be used for such identification.

Figure 9:
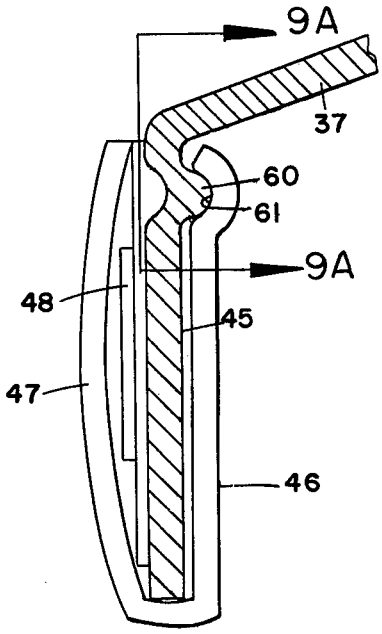
FIG. 9 is a partial, cross-sectional, side elevational view of an indicia part of the tray of this invention.
Figure 9A:
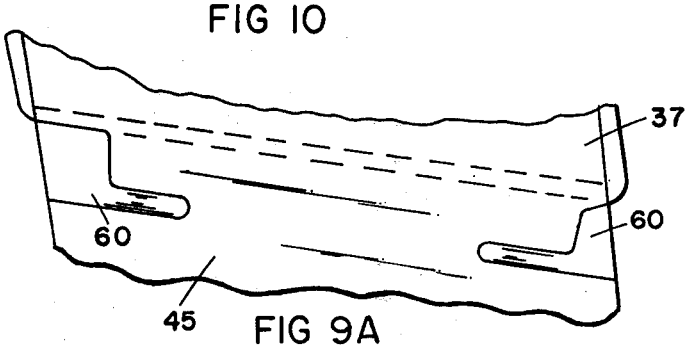
FIG. 9A is a cross-sectional view taken along the plane 9A—9A of FIG. 9.

Another unique way of identifying the material in the tray is shown in FIGS. 9 and 9A wherein the flange 45 is shown having the embossed portions 60 at each end immediately below the bottom wall 37. The embossed portions 60 form dimples which extend into groove 61 for holding the U-shaped plastic tag holder 47 on the flange 45. This U-shaped indicia holder is shaped to slip over the end of the flange 45 and hook over the dimple formed by the embossed portions 60. The label holder has a slot 48 for receiving and retaining a label card.

Figure 14:
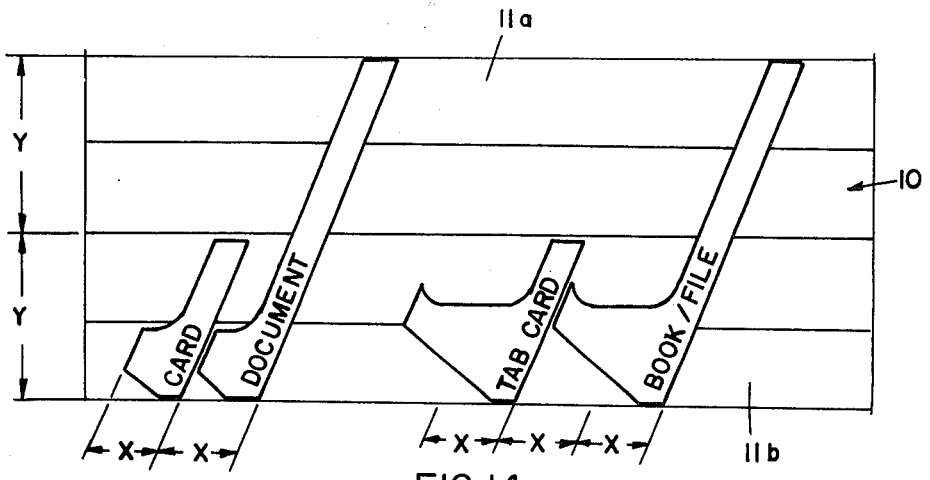
FIGS. 14, 15, 16 and 17 are schematic diagrams illustrating how the trays and back panels by reason of their modular construction can work together to provide a variety of versatile combinations.

FIGS. 14, 15, 16 and 17 illustrate some of the basic combinations of trays and support panels made possible by the modular construction of both the panel and trays. FIG. 14 discloses the four basic, modular size, trays. It discloses the vertical module is Y inches (preferably 5 inches) and the horizontal module is X inches (preferably 2 inches). Thus, as shown, the Card tray and the Tab Card tray are one module (5 inches) high and the Book/File tray and Document tray are two modules (10 inches) high. It will also be noted that the slats 11*a* and 11*b* are each one module (5 inches) high. FIG. 14 further shows the Card and Document trays are each one horizontal module (2 inches) wide and the Tab Card and Book File trays are two horizontal modules (4 inches) wide. By making all of the trays vertical modules high and horizontal modules wide the layout of the trays can be more easily developed in order to determine how the document handling system for any one particular station can be set up.

Figure 15:
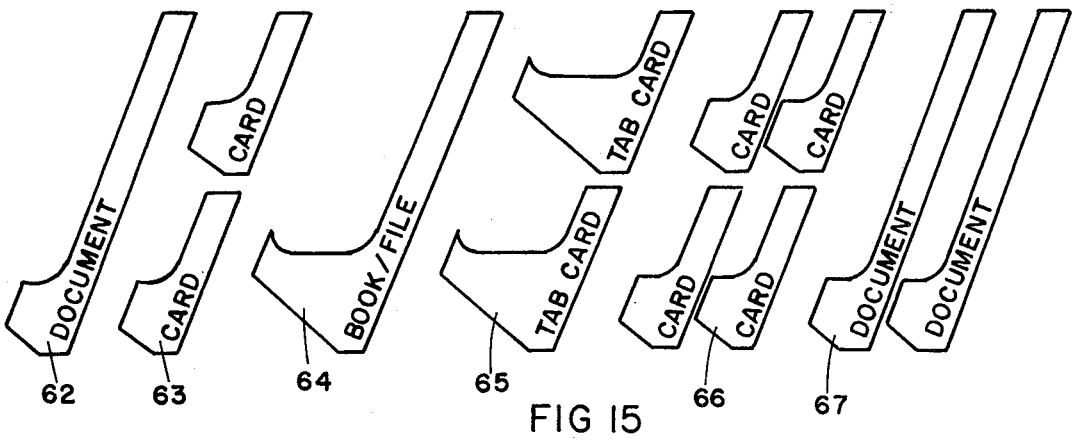

FIG. 15 helps to understand this modular concept. It discloses the various blocks formed by a tray or combination of trays. For example, blocks 62 and 63 are one module wide by two modules high while blocks 64, 65, 66, and 67 are two modules wide by two modules high. By this system of dividing the support panel into a number of blocks of various modules of width and height and knowing what tray or combination of trays constitutes certain sizes of blocks, the particular arrangement of trays for any requirement can be determined.

Figure 16:
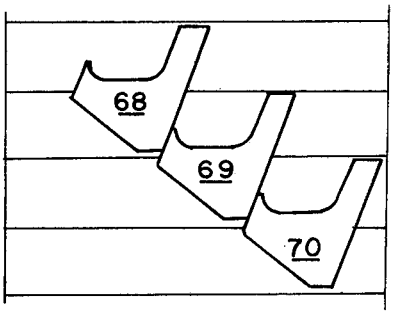

FIG. 16 illustrates the unique reason for the slats 11 having slots and panel hooks at every "half-vertical-module" intervals (2½ inches). Such an arrangement not only permits hanging of the trays at increased variable intervals but it also allows the trays, such as illustrated by trays 68, 69 and 70 to be placed diagonally. Such diagonal placement provides flexibility to accommodate specific procedures and allows a larger number of trays to be hung on a back panel.

Figure 17:
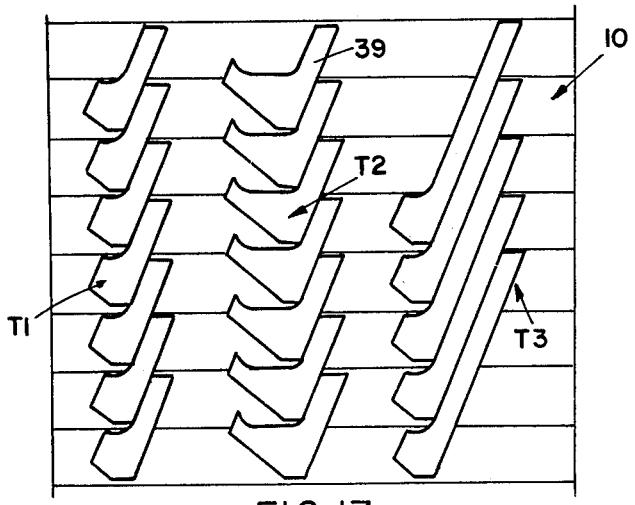

FIG. 17 shows another unusual advantage of the "half-vertical-module" slots and hooks on the support panel 10. Combined with the cutout sections in the back wall 39 of the tray, the "half-vertical-module" location of the slots and hooks permits a very dense tray arrangement and essentially the placement of the trays in a vertical line. Such dense arrangements are particularly useful where a large number of categories of papers are required (i.e., a category for each letter of the alphabet).

OPERATION

The operation of this system should be obvious from the description. The person using the system will choose that type of tray adapted for holding the type of document which he is processing or organizing. Such documents may include letters, reports, books, tab cards, computer cards, file cards, and the like. In every instance, it is only necessary that the panels be sufficiently wide from top to bottom to support the trays. Since the slats forming the panels 10 are modular and the distance between the hooks 44 on the trays use the same module, the person using the system only need be concerned that the width from top to bottom of the panel 10 is sufficient to accommodate the tray holder for the documents which such person is handling.

It will be evident then that the installer merely chooses the proper number of slats 11 and the proper length of posts 12. The assembler then merely plugs the tabs 19 into the openings in the ends of the slats 11*a*, 11*b* or 11*c* and these mounts the panel either on a free-standing support such as shown in FIG. 3 or another support means such as shown in FIGS. 10 and 13.

The person then using the system hooks the trays "T" on the panel 10 and stacks the documents in the trays. It should be observed that when placing the document into the tray the upward slope of the bottom wall 37 causes that document to slide backwardly into abutment against the back wall and the slope of the bottom 37 also causes the document to slide against the side wall 38. From time to time it is necessary to transfer documents from one station to another and rather than grabbing the pile of documents in any one tray, the entire tray is removed from the panel 10 and is carried to and hung on a panel at the next station where further processing is accomplished on the document.

It should become obvious that this is a simple system for handling and processing documents in an organized and concise way. This is accomplished with simple apparatus that is easily assembled and installed. With this apparatus, problems of processing and handling documents that are in an "active" state is made much easier resulting in improved organization and classification of such documents.

MODIFICATIONS

Figure 7:
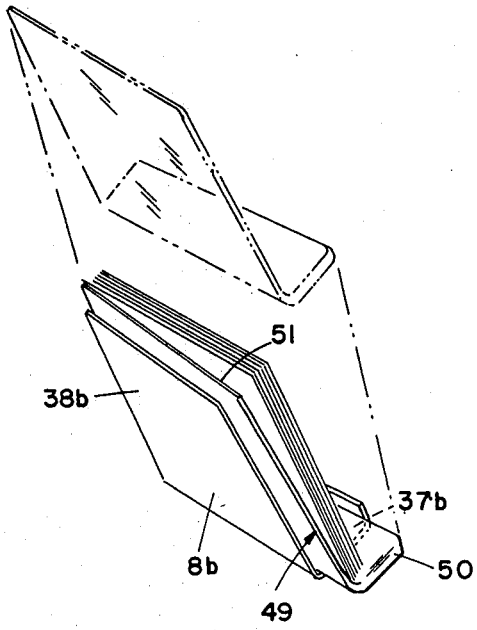
FIG. 7 is a perspective, side elevational view of one of the trays of this invention with an accessory insert.
Figure 8:
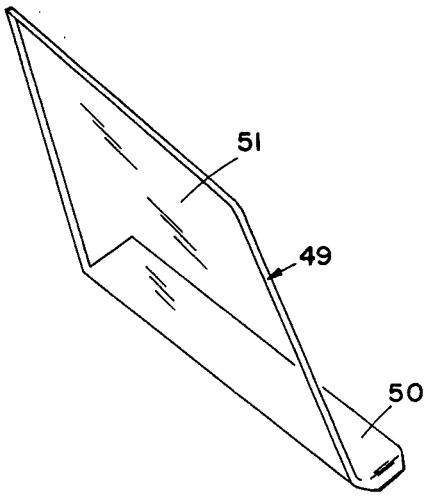
FIG. 8 is a perspective, side elevational view of the insert shown in FIG. 7.

FIGS. 7 and 8 show a modification which is principally adapted for use in printouts on computer machines. These printouts are especially long and as a result on the normal size tray would drape around the edge creating an unsightly mess and often getting into the way of the person using the system. These problems have been solved by providing an extra length insert which is plastic piece of material formed into substantially the identical shape of the bottom wall and side wall of the trays. This plastic insert 49 as shown in FIGS. 7 and 8 includes the bottom wall 50 and the side wall 51 arranged at the same angle with relation to each other as the side wall 38*b* and bottom wall 37*b* of the tray 8*b*. It will be noted that the primary difference between the side wall 51 and 38*b* is that side wall 51 has a greater height and length to accommodate the extra large sheets of printout material. This is also true of the bottom wall 50 which compared with the bottom wall 37*b* of the tray is longer to accommodate the longer length of printout documents.

In the use of insert 49 in handling documents, it is placed directly in the tray 8*b* and it alone can be moved with the documents therein or the entire tray 8*b* with insert 49 and documents can be moved.

Figure 12:
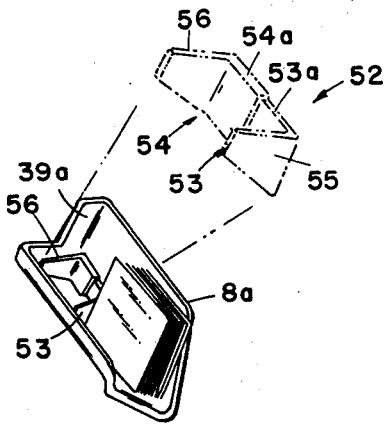
FIG. 12 is a side elevational view of a spacer used in conjunction with a tray of the present invention especially for adapting the tray for accommodating different sizes of documents.

Another accessory extremely useful with the trays as above described is the adjustable back stop 52 as disclosed in FIG. 12 which shows the back stop both within the tray and in phantom removed from the tray. This adjustable back stop includes a two piece assembly including the stop member 53 and the stop member 54. Stop member 53 is an L-shaped member including a leg which forms the stop plate 55 having the shape of a truncated isosceles triangle and leg 53*a* telescopically received with the leg 54*a* of stop member 54 which also has a stop plate 56 of the same shape as stop plate 55. The telescoping structure of legs 53*a* and 54*a* permits the spacing between the plates 55 of stop member 52 and 56 of stop member 54 to be adjusted. The back stop 52 rests inside the tray 8*a* as shown in FIG. 12 and in phantom in FIG. 6 with the plate 56 abutting against the back wall 39*a*. This locates the plate 55 between the back wall 39*a* and the front of the tray to thereby provide a back stop for short documents. With this adjustable back stop the short documents are located at the front of the tray in position for retrieval.

By reason of the shape of plates 55 and 56, the adjustable back stop 52 can be used in either a right hand or left hand tray. More specifically, the plates 55 and 56 are formed of truncated isosceles triangles, the angles of the sides of the triangles matching the angle of slope or inclination of the bottom wall 37 as shown in phantom in FIG. 6. Accordingly, when used in a right hand tray such as tray 8*a* of FIGS. 6 and 12, the plates rest on one edge or side of the triangle and when used in a left hand tray such as tray 5 (FIG. 6) the plates rest on the opposite edge or side of the triangle.

Having described our invention, it should be understood that although we have described a preferred embodiment thereof, other embodiments are possible within the broadest aspect of this invention and therefore our invention should not be limited except as provided by the following claims.

The embodiments of the invention in which an exclusive property or privilege is claimed are defined as follows.

1. In a manual paper handling system for processing and handling paper comprising a support structure presenting a vertical support panel means for handling a plurality of trays therein; a plurality of trays, said trays and support structure having cooperative mounting means for permitting easy, removable hanging of said trays on said support panel; the improvement comprising:

said support panel including a plurality of horizontally oriented slat members mounted one above the other; said slat members each having at least one horizontally extending recess in its front face, said recess extending rearwardly and downwardly of the front surfaces of said slat members to form a hook receiving structure for supporting said trays; said trays each having at least one hook receivable within said hook receiving structure; vertical support means on each end of said slats and each vertical support means having a surface facing one of the ends of said slats, means projecting from said surfaces toward said ends of said slats, at least a portion of said projecting means extending in a plane generally parallel to said front face of said slats, each of the ends of said slats having means receiving said projecting means and cooperating with said projecting means to mount the slats on said vertical support means.

2. The system of claim 1 in which said vertical support means are elongated members having a generally rearwardly projecting bracket having hook means adapted to be inserted into a second support means whereby said entire system can be supported by said second support means.

3. The system of claim 1 in which said plurality of slat members are integrated into a single support panel solely by means of their interconnection to said vertical support means.

4. The system of claim 1 in which said support means are each an elongated member having a horizontally extending base leg and a vertically extending support.

5. The system of claim 4 in which said plurality of slat members are integrated into a single support panel solely by means of their interconnection to said vertical support means.

6. The system of claim 4 in which a C-shaped clip is secured on the horizontally extended base leg for clipping onto a table or the like.

7. The system of claim 1 in which the trays have at least two hook means spaced at modular distances, said hook receiving means of said slats being also spaced at modular distances whereby trays of various sizes and shapes can be mounted on said support panel means.

8. The system of claim 7 in which said plurality of slat members are integrated into a single support panel solely by means of their interconnection to said vertical support means.

9. The system of claim 1 in which a holder insert of substantially the same vertical cross section shape as said tray is fitted into said tray, said holder insert being substantially larger than said tray in at least the length dimension.

10. The system of claim 1 in which a holder insert of substantially the same vertical cross section shape as said tray is fitted into said tray, said holder insert being substantially larger than said tray in at least the height dimension.

11. The system of claim 1 in which a holder insert of substantially the same vertical cross section shape as said tray is fitted into said tray, said holder insert being substantially larger than said tray in both the length and height dimensions.

12. The manual paper handling system of claim 1 wherein said vertical support means include a U-shaped bracket for supporting said slats.

13. The system of claim 12 in which the trays have hook means adjacent the top thereof and intermediate the top and bottom thereof.

14. The system of claim 12 in which said trays have hook means spaced along the vertical a module or multiples thereof so as to be adapted to hook onto two spaced mounting means.

* * * * *